United States Patent [19]

Reed et al.

[11] 4,154,572

[45] May 15, 1979

[54] ACCESS FOR FLARED GAS TO STEAM IN FLARES

[75] Inventors: Robert D. Reed; John S. Zink; Robert E. Schwartz, all of Tulsa, Okla.

[73] Assignee: John Zink Company, Tulsa, Okla.

[21] Appl. No.: 816,190

[22] Filed: Jul. 15, 1977

[51] Int. Cl.[2] ..... F23D 13/20

[52] U.S. Cl. ..... 431/202; 431/5; 431/190

[58] Field of Search ..... 431/4, 5, 202, 190; 23/277 C

[56] References Cited

U.S. PATENT DOCUMENTS

| | | | |
|---|---|---|---|
| 3,134,424 | 5/1964 | Zink et al. | 431/202 |
| 3,512,911 | 5/1970 | Reed et al. | 431/202 |
| 4,039,276 | 8/1977 | Reed et al. | 431/202 |

*Primary Examiner*—Edward G. Favors

*Attorney, Agent, or Firm*—Head, Johnson & Chafin

[57] ABSTRACT

An improved flare system in which steam is injected into the column of gas to be burned, from circumferential nozzles at at least two spaced levels, above the tip of the flare stack. A circular manifold surrounds the stack just below the tip and an even number of small diameter riser pipes are attached to the manifold, spaced equally circumferentially. The riser pipes have nozzles all of which are directed radially inwardly and upwardly at a selected angle. Half of the nozzles are spaced at a first selected distance above the tip of the flare stack, and the other half are positioned at a greater selected elevation above the tip of the flare stack. Alternate risers have different elevations of the nozzles. By this means, a minimum diameter of the cross-section of the gas flow is occluded by the steam flow.

6 Claims, 8 Drawing Figures

ACCESS FOR FLARED GAS TO STEAM IN FLARES

BACKGROUND OF THE INVENTION

1. Field of the Invention

This invention lies in the field of smokeless burning of waste gases in flare stacks.

More particularly, it concerns the injection of high velocity jets of steam radially inwardly and upwardly into the column of gas flowing above the tip of the flare stack, for mixing with the gas, for creating a chemical atmosphere to improve the smokeless combustion of the gas.

Still more particularly, this invention involves the use of nozzles for injection of steam at at least two different elevations above the tip of the flare stack. Half of the nozzles are at a low selected elevation above the tip, and the other half are at a higher elevation above the tip. Sequential circumferential jets being low and high.

2. Description of the Prior Art

It is common in the art of smokeless flaring of vented glass, for steam injection into the gas column below the burning zone and above the flare discharge point or tip of the stack, for the purpose of suppression of smoke, as the gas is burned in the atmosphere. The gas is entrained or mixed with the steam. The effectiveness of smoke suppression, and the efficiency of smoke suppression, in point of the steam-to-gas weight ratio, depends upon the completeness of steam-gas mixture prior to burning of the flare gas.

In the present state of the art of smokeless flaring, U.S. Pat. No. 2,779,399 is typical, while U.S. Pat. No. 3,134,424 represents an effort to improve the gas-steam mixture condition through the use of plural steam ports per steam injection device, where the flow paths of steam from each of the ports may deviate angularly from the horizontal plane, as well as from a line between flare tip center line and the center line of the steam tip, to distribute steam, at the expense of gas access to steam, as discharged. In U.S. Pat. No. 2,779,399 the steam discharge is both radially inwardly and at the same level above the flare tip in circumerential spacing above and about the tip. In U.S. Pat. No. 3,134,424, the device shows mixture advantage of the port arrangement for the steam tip and varying steam discharge levels above the flare tip where adjacent and equivalent orifices were at the same elevational level above the flare tip. However, the mixture advantage obtained was less than satisfactory as a final condition because the steam, as it travels forward from the ports, is denied suitable access to the gas stream. In other words, the gas flow was occluded by the steam flow.

SUMMARY OF THE INVENTION

It is a primary object of this invention to provide an arrangement of multi-port steam jet injections into a rising column of gas above the tip of a flare stack for maximum smoke suppression.

It is a further object of this invention to provide a more effective and efficient application of steam to the gas flow from a flare stack, so as to provide smoke suppression with a smaller weight ratio of steam to gas, than in the prior art.

In the present invention, the advantage of varying elevation above the gas discharge tip for the discharge of steam from steam ports is retained, but the steam discharge paths are such as to avoid occlusion of gas from steam, as much as it is possible to do so. Also the steam is discharged from the steam ports in substantially parallel paths, from each of the discharge devices, at the same azimuth around the flare stack.

In the preferred form there is an even number of steam riser pipes attached to a circumferential steam manifold positioned just below the tip of the flare stack. There is at least one steam orifice in each of the riser pipes. Half of the orifices are at a slected small distance above the tip of the flare. The other half of the steam orifices are at a larger selected distance above the flare tip. The angle of injection of steam from the orifices is radially inwardly and upwardly at a selected acute angle, which is constant for all of the orifices. Of the even number of risers and jets, alternate risers have orifices at the lower level, and the intermediate risers have their orifices at the higher level.

This combination of jets applies steam to the gas flow at two distinct zones, one above the other, and provides intimate mixing of the steam with the gas prior to combustion, with a greater efficiency of smoke suppression for a given amount of steam. Expressed differently, the steam to gas weight ratio for complete smoke elimination is at a minimum.

As has been stated, the preferred form of our invention makes use of an even number of steam riser pipes attached to the circular manifold where the riser pipes are evenly and circumferentially spaced about the flare discharge tip. But it is possible to make use of an odd number of steam riser tubes for any of a number of reasons at the small disadvantage of adjacent steam travel interfering at a single point about the circumference of the flare rather than about the entire circumference.

BRIEF DESCRIPTION OF THE DRAWINGS

These and other objects and advantages of the invention and a better understanding of the principles and details of the invention will be evident from the following description, taken in conjunction with the appended drawings in which.

DESCRIPTION OF THE PREFERRED EMBODIMENT

Figure 3:
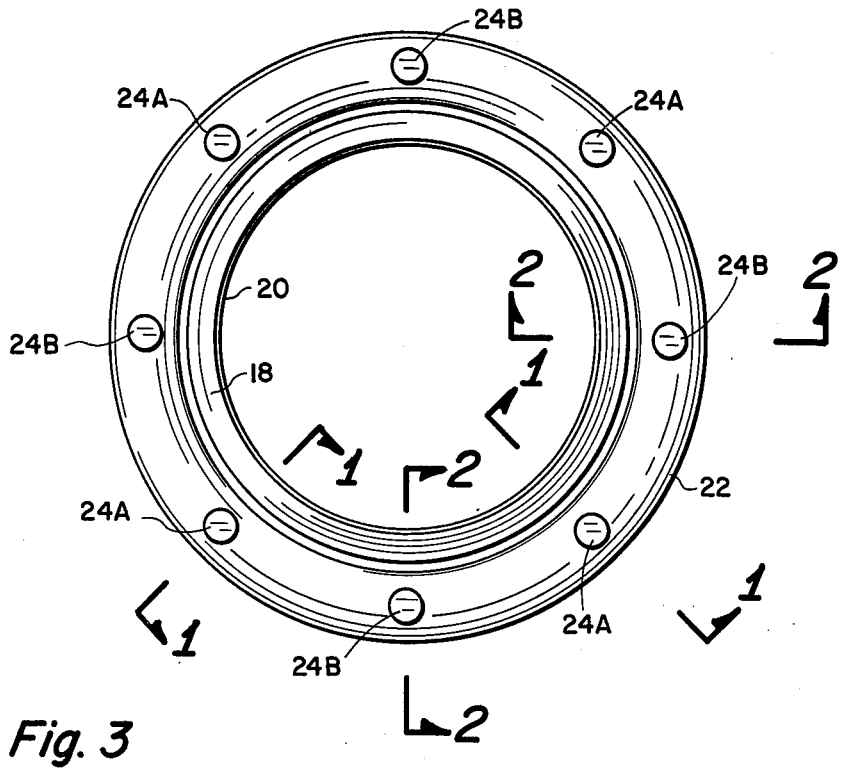
FIG. 3 is a plan view of the preferred embodiment, indicating alternate riser pipes according to FIGS. 1 and 2.

Referring now to the drawings and, in particular, to FIGS. 1, 2 and 3, there is shown in cross-section, one embodiment of this invention involving a plurality of riser pipes 24A, 24B supported from a steam manifold 22 which surrounds a flare stack 10, below the top thereof. The flare stack 10 has a tip 14 which is joined at line 12 to the top of the stack. The tip has a circular cylindrical portion 16, and an inwardly and upwardly directed flange 18, which provide a central opening 20 through which the gas flow occurs as a column 25.

Each of the riser pipes 24A and 24B has a single orifice 38 and 40 respectively, the tops of the riser pipes being closed by plates 26. The orifices 38 and 40 are directed radially inwardly and upwardly of the horizontal plane, at a selected angle, such as 32. Steam flows through the orifices as indicated by the arrows 34A and 34B. The orifices 38 are at a selected small dimension 26 above the tip 14 of the flare stack. The orifices 40 in the alternate riser pipes 24B are positioned at a greater elevation indicated as dimension 27, above the top of the tip 14 of the flare stack. There is a substantial difference in spacing (27–26) between the two sets of orifices so that in effect the steam jets interact with the gas flow in two distinct regions of the rising column of gas, or two-stage, or two-zone interaction is provided.

FIG. 3 illustrates in plan view the presence of eight riser pipes 24A, 24B, alternate ones having orifices at the elevation 27, and intermediate riser pipes having orifices at the elevation 26 above the tip of the flare stack.

Figure 4:
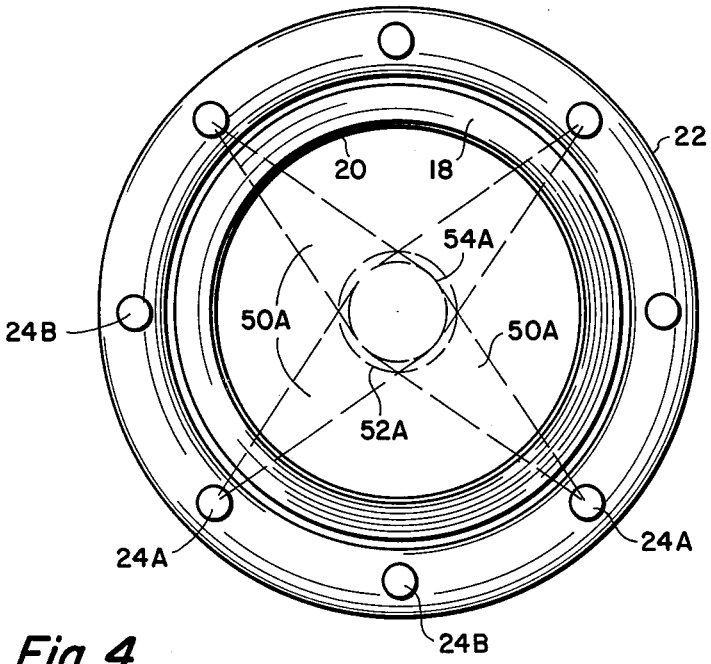
FIGS. 4 and 5 show the area of distribution of steam in the steam jets directed radially inwardly and upwardly, in accorance with FIGS. 1, 2 and 3.
Figure 5:
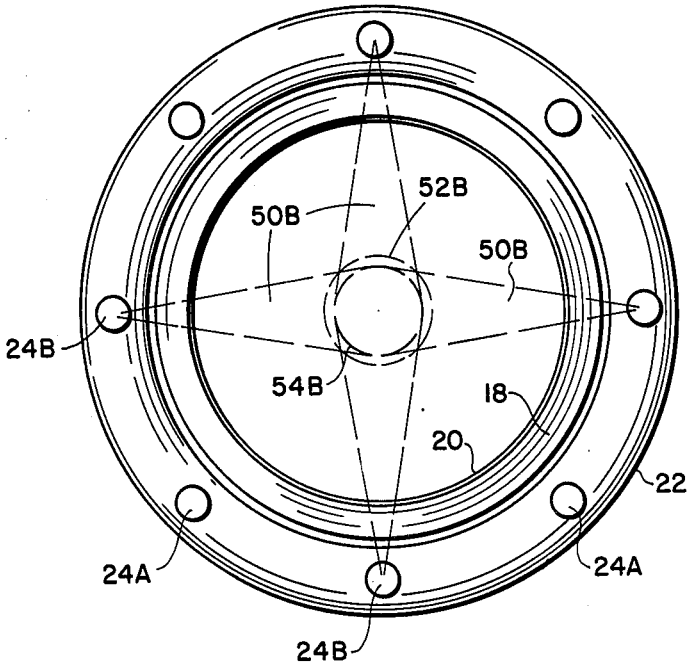

Referring now to FIGS. 4 and 5, there is shown in schematic fashion in plan view, the steam jets 50A from the risers 24A in FIG. 4, and the jets 50B from the orifices 40 in the riser pipes 24B. Circles 52A and 52B are drawn through the intersections of the outer surfaces of the jets 50A and 50B, and represent the maximum area of occlusion, or obstruction, of the gas to the flow of steam. If there were only two opposing jets the circle of occlusion of 54A and 54B would be somewhat smaller. In FIG. 4 there is a corresponding pattern of jets and circles of occlusion from the orifices in the riser pipes 24A, which is similar to that of FIG. 5 but rotated by an angle of 45°. It is clear also though not shown in FIGS. 4 and 5 that the pattern of jets are in two different elevations, the pattern of jets in FIG. 4 being at the elevation 26 and in FIG. 5 in the elevation 27 above the tip of the flare stack.

There is convergent flow of the steam from each of the four orifices in FIG. 4 and likewise in FIG. 5, providing a minimum circle of occlusion. The areas of occlusion in FIGS. 4 and 5 are approximately 9% of the gross gas flow area.

While only eight riser pipes and orifices are shown, there can, of course, be any desired number. For larger flare stacks there would normally be a greater number. However, in this invention there should be an even number of risers and orifices except as previously stated.

Figure 1:
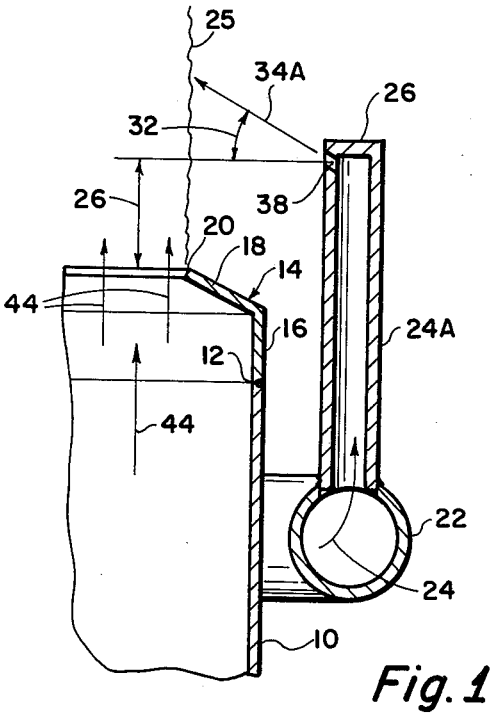
FIGS. 1 and 2 show in cross-section alternate circumferentially spaced steam riser pipes and orifices.
Figure 2:
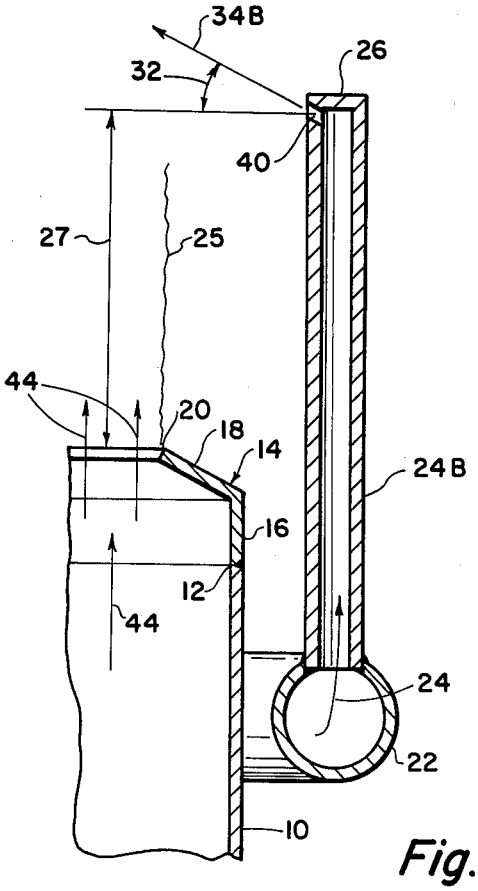
Figure 7:
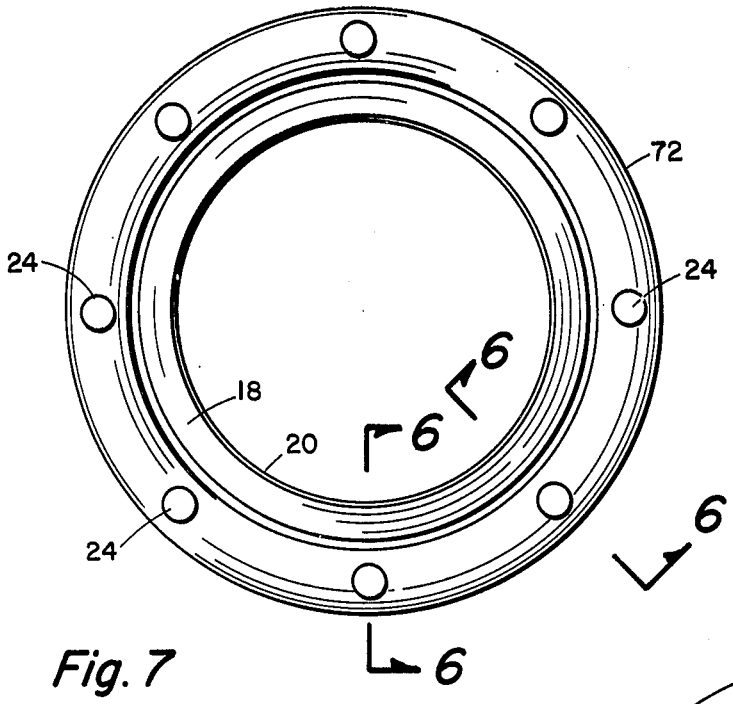
FIGS. 6 and 7 illustrate a second embodiment of the invention in which all riser pipes are alike and each has at least two vertically spaced steam jets.
Figure 6:
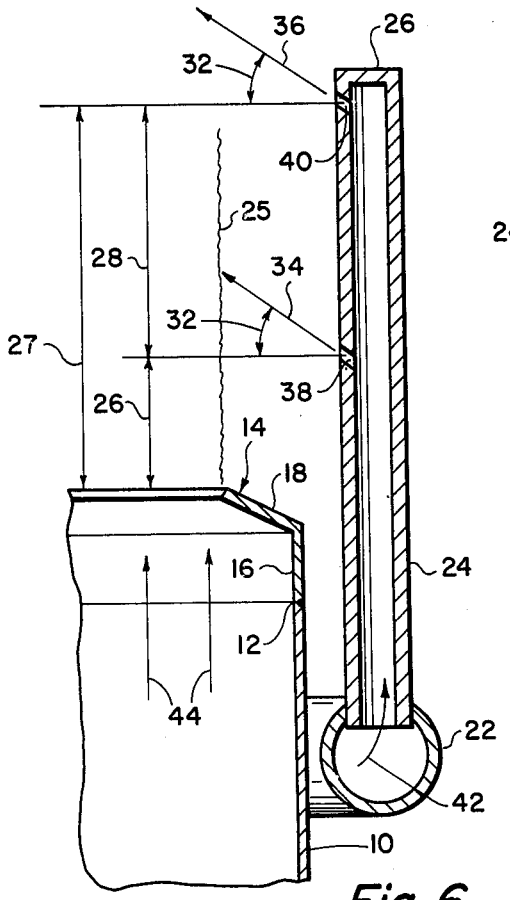

Referring now to FIGS. 6 and 7, a similar design of riser pipe is shown as in FIGS. 1 and 2, with the gas flow 44 upwards through the central opening 20 of the stack. However, FIG. 6 differs from FIGS. 1 and 2 in that all riser pipes are of the same elevation and in each riser pipe there are two orifices 38 and 40 with the lower orifices 38 being at the same height 26 above the tip of the flare stack, while the upper orifices 40 are at an additional elevation 28 above the lower orifice 38, making a total distance above the tip of the top orifice equal to the dimension 27 of FIG. 2.

As shown in FIG. 7, all riser pipes are similar and each has two orifices 38 and 40 directing steam in accordance with arrows 34 and 36 at selected angle 32 above the horizontal.

In both embodiments of FIGS. 1 and 2, and FIG. 6, the total quantity of steam required is a function of the total gas flow. Assuming the gas flow is equal in the two cases, then the total steam flow would be equal, and, therefore, in view of the two orifices per riser pipe the flow of steam per orifice would be one half in FIG. 6 what it would be in the combination of FIGS. 1 and 2.

It has previously been stated that the area of occlusion of the gas flow should be a minimum, and, therefore, the embodiments of FIGS. 1, 2 and 6 are preferred in that in each of two levels, there is a minimum area of occlusion, and the areas are separated vertically by substantial distances, which in FIGS. 1 and 2 is the differences between 26 and 27, and in FIG. 6 is the distance 28. In the embodiment of FIG. 6 there are eight orifices at each level. However, because of the double number of orifices, with a preferred flow of steam, the flow of steam per orifice is one half. Therefore, the angular width of the jets, and, therefore, the area of occlusion is reduced, even though the greater number of jets at the same level above the flare tip would provide a larger area of occlusion as shown in FIG. 8, but to a significantly lesser degree.

Figure 8:
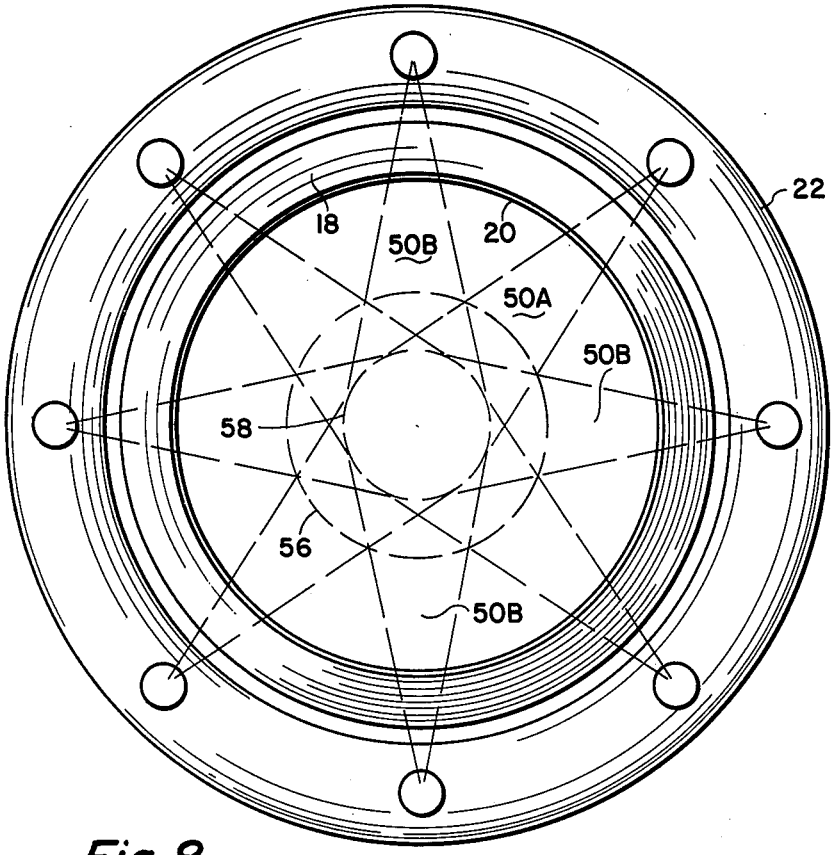
FIG. 8 illustrates the prior art case of steam flow from all jets at the same elevation.

FIG. 8 serves two purposes. First of all, it illustrates the conventional type of steam flow as covered in U.S. Pat. Nos. 2,779,399 and 3,134,424. Here all of the orifices are at the same level, and the combination of twice as many orifices at a given level automatically increases the area of occlusion in accordance with the circle 56 of FIG. 8. This is the disadvantage of the prior art. In FIG. 6, since there are two layers of orifices, there is a flow in each of the orifices as in FIG. 8 of one half that which would be in the conventional type of orifice system, and, therefore, the beams 50A and 50B would be narrower and the circle 56 would shrink to approach the circle 58, which corresponds to the case of FIGS. 4 and 5.

This is the same situation in FIG. 6. While there are, for example, eight orifices at each level, the levels are sufficiently separated so that they are considered independent and do not interfere with each other, and since the volume of steam through each orifice is reduced to half of that of FIGS. 4 and 5, then the area of occlusion is not likely to be larger if any than that shown in FIGS. 4 and 5.

In review, the principal difference and advantage of this invention over the prior art lies in the provision of two stages for the application of steam injection to the gas for the same total steam quantity to a selected total quantity of gas. In other words, for a constant steam-to-gas ratio, the steam is divided equally and flows into two distinct zones vertically separated from each other. In each of the vertically separated areas the steam injection will be smaller volume per jet for the total number of risers, or can be a double flow rate per jet for half the total risers. In the latter case, of course, the orifices at each level representing half of the risers are alternated in position so that there will be less occlusion of the gas flow, and, therefore, maximum availability of steam to the gas.

The important factor is that there are two vertically separated zones, and this vertical separation is adequate so that the jets of steam will allow gas access to the entire perimeters of the steam jets for a major portion of the travel toward the center of the opening 20. Entrainment of gas is a peripheral function of moving steam jets and is according to velocity at which the steam is moving in relation to the gas.

The important point about this invention is the two-stage, or multi-stage injection of steam into the gas column, where the vertical separation of the stages, or zones, is substantial. Each stage can include half of the orifices (alternate) at each level injecting steam at full flow per orifice, or all orifices at each level injecting steam in each stage, or zone, at a fractional flow per orifice.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A flare system for burning waste gases in the atmosphere, having improved access of steam to the column of gas, prior to combustion, for the purpose of smokeless combustion, comprising, (a) circumferential steam manifold around the top of the flare stack, and an even number of circumferentially spaced riser pipes rising from said manifold to a level above the tip of said flare stack;

(b) an orifice in each riser pipe, each orifice directed radially inwardly and upwardly at a selected angle above the horizontal and having a selected weight rate of steam flow of F;

(c) half of said riser pipes positioned such that its orifice is at a first selected elevation A above said tip of said stack, and the other half of said riser pipes positioned such that the orifice is at a selected elevation B above said tip, where the difference in elevation (B-A) is a selected substantial dimension;

(d) the orifices in adjacent riser pipes being at different elevations.

2. The flare system as in claim 1 in which the area of gas occlusion by the steam at each elevation, A and B, is of the order of 10% of the area of the gas column.

3. A flare system for burning waste gases in the atmosphere, having improved access of steam to the column of gas, prior to complete combustion, for the purpose of smokeless combustion, comprising;

(a) a circumferential steam manifold around the top of the flare stack, and a selected number of circumferentially spaced riser pipes rising from said manifold to a level above the tip of said flare stack;

(b) plural longitudinally-spaced orifices in each riser pipe, each orifice directed radially inwardly and upwardly at a selected angle above the horizontal;

(c) the lowest orifice in each riser, all in the same first horizontal plane, a first selected distance D above the tip of said stack;

(d) at least a second orifice in each riser, all in the same second horizontal plane, at a second selected distance E above said first plane, of said lowest orifices, and (e) the spacing between orifices and the flow rate of steam per orifice are such that the area of contact with the upwardly flowing column of gas, of the steam jet from each orifice is independent of the areas of contact from adjacent jets.

4. The system as in claim 3 in which the number of said riser pipes is an even number.

5. The system as in claim 3 in which the number of said riser pipes is an odd number.

6. The system as in claim 3 including;

(e) at least a third orifice in each riser, all in the same third horizontal plane at a third selected distance F above said second plane, of said second orifices, where distance F is at least as large as the largest of D and E.

* * * * *